US010024616B2

(12) United States Patent
Elftmann

(10) Patent No.: US 10,024,616 B2
(45) Date of Patent: Jul. 17, 2018

(54) PIN RETENTION CLIP FOR TRIGGERS

(71) Applicant: Arthur J. Elftmann, Glendale, AZ (US)

(72) Inventor: Arthur J. Elftmann, Glendale, AZ (US)

( * ) Notice: Subject to any disclaimer, the term of this patent is extended or adjusted under 35 U.S.C. 154(b) by 0 days.

(21) Appl. No.: 15/454,333

(22) Filed: Mar. 9, 2017

(65) Prior Publication Data

US 2017/0184363 A1 Jun. 29, 2017

Related U.S. Application Data

(63) Continuation of application No. 14/715,304, filed on May 18, 2015, now Pat. No. 9,593,898.

(51) Int. Cl.
*F41A 19/10* (2006.01)
*F41A 19/14* (2006.01)

(52) U.S. Cl.
CPC ..... *F41A 19/10* (2013.01); *F41A 19/14* (2013.01)

(58) Field of Classification Search
CPC ..... F41A 19/10; F41A 19/14; F41A 19/15
See application file for complete search history.

(56) References Cited

U.S. PATENT DOCUMENTS 1,121,053 A 12/1914 Terry
2,012,947 A 9/1935 Bosnian
3,359,815 A 12/1967 Mueller
3,709,054 A 1/1973 Montano
3,847,031 A 11/1974 Araya
3,885,445 A 5/1975 Montano
5,857,318 A 1/1999 Odai
6,722,072 B1 4/2004 McCormick
6,782,688 B2 8/2004 Garbagnati
7,421,937 B1 9/2008 Gangl
9,021,733 B1 5/2015 DiChario
9,046,313 B1 6/2015 Lutton
9,528,782 B2 * 12/2016 Meier ..... F41A 3/66
2004/0033854 A1 2/2004 Wu
2006/0264288 A1 11/2006 Allen
2007/0219034 A1 9/2007 Wu
2016/0033219 A1 2/2016 Meier
2016/0187092 A1 6/2016 Mather

OTHER PUBLICATIONS

Nsz85, "AR-15 Upgrade! KNS Precision Non-Rotating Pins Installation", Jan. 14, 2013, youtube.com.*
AK Retainer Plate Manual, May 28, 2014, CNC Warrior.
DPMS AntiWalk Hammer & Trigger Pins AR15, Nov. 23, 2011, midwayusa.com.
AR-15—Upgrade! KNS Precision Non-Rotating Pins Installation, Jan. 14, 2013, youtube.com.
TAPCO Hammer and Trigger Pin Retainer Plate AK47 Steel Blue, Feb. 23, 2012, midwayusa.com.
Power Custom Hammer and Trigger Pin Retainer Plate AK-47, Dec. 31, 2012, midwayusa.com.
KNS Precision Gen2 Mod1 Trigger Group Pins.

* cited by examiner

*Primary Examiner* — Stephen Johnson
*Assistant Examiner* — Joshua T Semick
(74) *Attorney, Agent, or Firm* — Douglas W. Rudy

(57) ABSTRACT

A trigger assembly retention apparatus. It is useful in allowing the easy removal and reinsertion of a trigger assembly of a gun for cleaning, replacement, inspection or the trigger assembly or any other reason.

2 Claims, 3 Drawing Sheets

PIN RETENTION CLIP FOR TRIGGERS

CROSS-REFERENCE TO RELATED APPLICATION

This application is a continuation of U.S. patent application Ser. No. 14/715,304, filed May 18, 2015; now U.S. Pat. No. 9,593,898, issued Mar. 14, 2017.

BACKGROUND OF THE INVENTION

Field of the Invention

This invention is a pin retention clip for holding a trigger assembly in a gun. The trigger may be a modular trigger that is designed to be inserted and removed from a gun on occasions when the user of the gun wants to change the removable trigger for another trigger assembly. This pin retention clip is easily removed and replaced to yield a secure restraint device for retaining a trigger in a host rifle.

Description of Known Art

Trigger pins for retaining a trigger in a gun are available from at least one manufacturer. KNS Precision manufactures the Gen2, Mod1 Trigger Group Pins as well as other similar models of trigger pins. The KNS product isn't as easy to use as the instant invention. There are two side plates, two pins, two screws and two wrenches to a set of KNS trigger pins. To install the KNS pins the two wrenches are needed to screw in the two screws into nearside and offside threaded bores in one of the pins. The second pin of the set has a head that interfaces with the two side plates. These special headed pins prevent the rotation of the second pin by interfacing with the side plates. One disadvantage of the KNS pin set is that two specific allen wrenches are needed to install the small screws into the internally threaded pin. Cross threading and stripping of threads is a possibility with the KNS kit.

There are other trigger pin sets that use two internally threaded pins and four screws per set. One disadvantage to this type of pin is that it can rotate after being installed and perhaps allow the retaining screws to be loosed from torque engagement with the host pin.

Another type of trigger pin has pins that are flanged at one end and have a groove for accepting a retaining clip at the other end of the pin. These pins allow pin rotation.

Master links are known that are used for bicycle chains. They allow the chain to be "broken" at the master link when desired. The master link is positioned between two normal chain links and will usually function like a standard link of a chain in the transmission of force along the chain. In use there is tension on the master link of a bicycle chain as the chain transmits force from a front sprocket to a drive sprocket. What the normal master link in a bike chain transmits is force between two adjacent links. In this invention the pin retention clip doesn't transmit forces between links attached to the master link, but instead, the pin retention clip is used to hold a trigger module in the body or lower receiver of a weapon.

No quick release trigger retention devices are known to the inventor. In a normal trigger installation there are two screws, or in some cases, two friction pins, that are used to retain the trigger in the gun.

This device is an embodiment that allows the quick removal and reinstallation of a trigger out of and into a gun.

Applicant believes that the material incorporated above is "non-essential" in accordance with 37 CFR 1.57, because it is referred to for purposes of indicating the background of the invention or illustrating the state of the art. However, if the Examiner believes that any of the above-incorporated material constitutes "essential material" within the meaning of 37 CFR 1.57(c)(1)-(3), applicants will amend the specification to expressly recite the essential material that is incorporated by reference as allowed by the applicable rules.

BRIEF SUMMARY OF THE INVENTION

The present invention provides, among other things, a trigger assembly retention apparatus that is useful in allowing the removal and reinsertion of a trigger assembly for cleaning, replacement, inspection or any other reason.

One object of this invention is to provide a trigger retention apparatus that enables a gun user to quickly secure a removable or drop in trigger assembly into a gun.

Another object of the invention is to provide for the secure retention of a trigger assembly in a gun.

Also an object of the invention is to provide a replacement trigger retention device to replace the normal retention screws or pins that are used to hold a trigger in a gun.

A further advantage of this trigger pin retention system is that it can be removed with only a small screwdriver or similar tool and no further tools are needed for the removal of the pin retention clip.

Similarly, the trigger pin-retaining clip can be inserted and secured without the need for any tools or in some cases only the use of the small screwdriver or similar tool.

It is also an object of this invention to provide a pin retention device that is secure once installed.

One other object of the invention is that the pins are configured to prevent pin rotation when installed in a gun.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112, ¶6. Thus, the use of the words "function," "means" or "step" in the Detailed Description or Description of the Drawings or claims is not intended to somehow indicate a desire to invoke the special provisions of 35 U.S.C. § 112, ¶6, to define the invention. To the contrary, if the provisions of 35 U.S.C. § ¶6 are sought to be invoked to define the inventions, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . ." or "step for performing the function of . . . ," if the claims also recite any structure, material or acts in support of that means or step, or that perform the recited function, then it is the clear intention of the inventors not to invoke the provisions of 35 U.S.C. § 112, ¶6. Moreover, even if the provisions of 35 U.S.C. § 112, ¶6 are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

BRIEF DESCRIPTION OF THE DRAWINGS

A more complete understanding of the present invention may be derived by referring to the drawings in which.

Elements and acts depicted in the figure are illustrated for simplicity. They are presented to illustrate the invention to assist in an understanding thereof. The figure is not necessarily been rendered according to any particular sequence, size, scale or embodiment.

DETAILED DESCRIPTION OF THE INVENTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the invention is not limited to the examples that are described below.

Figure 1:
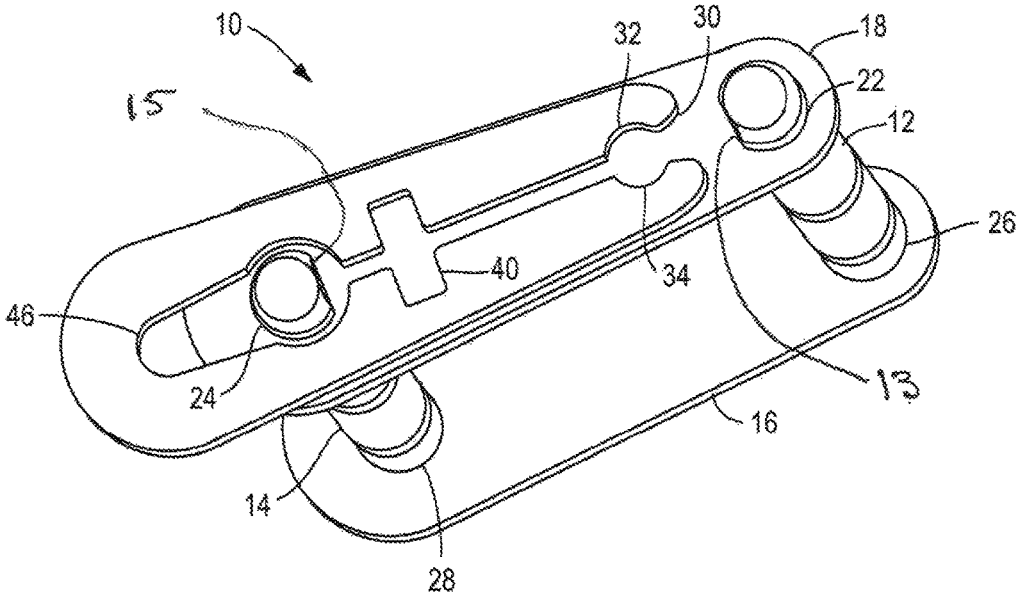
FIG. 1 is a projection view of a partially assembled pin retention clip.
Figure 2:
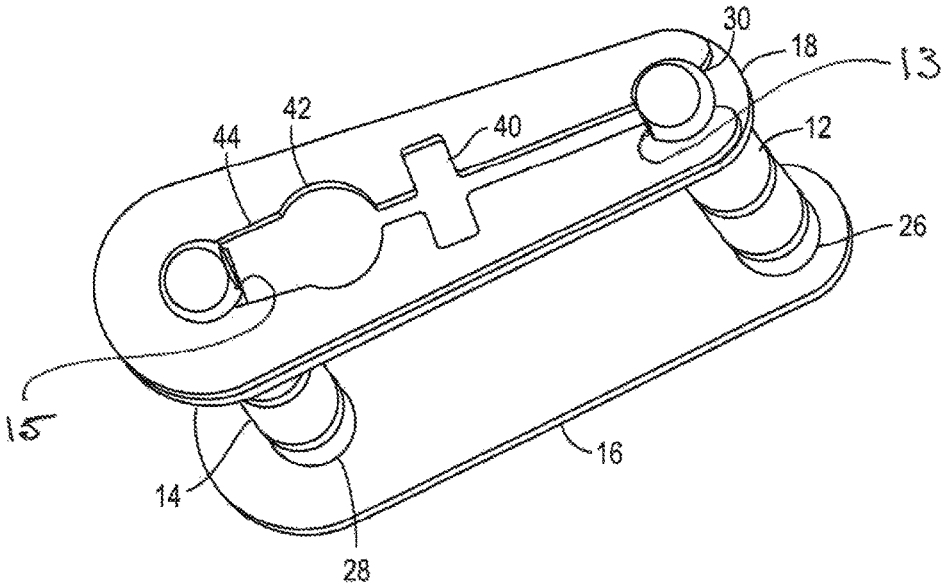
FIG. 2 is a view of the pin retention clip shown in FIG. 1 in an assembled configuration.

Turning to FIGS. 1 and 2, one embodiment of a pin retention clip, generally 10, in a partially assembled configuration is illustrated. There are five elements making up the pin retention clip 10. First there is a pair of pins, the first pin shown as 12 and the second pin shown as 14. These pins will pass through holes in a front plate 16 or first clip plate. The pins, 12 and 14, then pass through apertures in the gun. The pins will project a small distance beyond the external frame surface of the gun. With the pins projecting proud of the gun the back plate 18 or second clip plate, also having a pair of pin receiving holes, can be positioned over the protruding pins 12 and 14. The pin receiving holes in the back plate 18, one hole being 17 and the second hole being 19, are shaped to accept the flat surfaces, 13 and 15 of the pins as disclosed below. The pin receiving holes are generally round holes except for a section of straight edge of the holes. The straight edges of the holes will align with the flats on the pins to prevent pin rotation once the pin retention clip is installed on a gun. With the pins passing through the gun and then the pins passing through the back plate 18, the pin retention clip 10 is nearly secured in the gun. To complete the installation of the pin retention clip 10 a clip 20 is installed on the pins 12 and 14. This clip 20 is slid onto grooves, a first pin groove 22 is formed near the end of the first pin and a second pin groove 24 is formed near the end of the second pin 14. The clip 20 is slid, usually by thumb pressure only, from the initial position shown in FIG. 1 to the locked position shown in FIG. 2. If needed a screwdriver, or similar device, can be used to move the clip into the locked position by having the blade push on the edge of the rectangular cut out 40.

The first and second pins, 12 and 14, are cylindrical shaped and of length to extend from one side of the body of a lower receiver for a rifle to the opposite external side of the lower with a small length of each of the pins protruding beyond the sides of the gun. The pin length is slightly longer then the width of the gun. As mentioned above each pin has a flat surface formed on one end of each pin. The flat surfaces are at the end of the pin that the clip 20 will interface with when the pin is assembled. The flat surface of the first pin is shown as surface 13 and the flat surface of the second pin is shown as surface 15.

Not shown in the figures are the hidden ends of both pins. The hidden ends of the pins have enlarged area forming a flange that prevents the pins from being pulled all the way through the holes or apertures 26 and 28 in the front plate 16.

An alternative pin configuration is to have one of the pins, the second pin 14 for instance, with a flat milled surface forming a flat zone at the upper end, the end of the pin that has the second pin groove, of the second pin 14. The flat zone, in one embodiment would be facing relatively inboard toward the first pin. 12. This configuration may not, however, prevent the rotation of the pin without the flat surface and that may not be acceptable in all cases. Furthermore, the flat surfaces on both the pins can be eliminated or not formed in the first place. The round pins would present an alternative embodiment. In both of these alternative embodiments the back plate 18 would be provided with holes configured to accommodate whichever style of pin is being used in the pin retention apparatus.

The front plate 16 is of an oblong shape in top elevation view. The front plate, in one embodiment is wider at one end than it is at the other end. In the top elevation view the surface of the front plate surrounding the aperture 26 for the first pin 12 is not as wide as the surface of the front plate surrounding the aperture 28 for the second pin 14. This can be seen in FIGS. 1 and 2.

The back plate 18 is similar to the front plate 16. That is there are two holes formed in the back plate 18 and the pins 12 and 14 will be fitted through these holes when the assembly is use to hold a trigger assembly in a gun. Also the back plate 18 is wider at the second pin aperture location and not as wide, from a top elevation view, as the back plate at the first pin location.

The clip 20 is unique. It has a tapered shape when viewed from the top as in FIGS. 1-3. The clip 20 is made of spring steel in a preferred embodiment. It has an opening 30 at the more narrow end of the clip 20 where there is also a first pin groove 22 accommodating recess, a first curve 32 on one edge of a longitudinal through recess or slot 36 formed in the clip 20 and a second curve 34 opposite the first curve.

Figure 3:
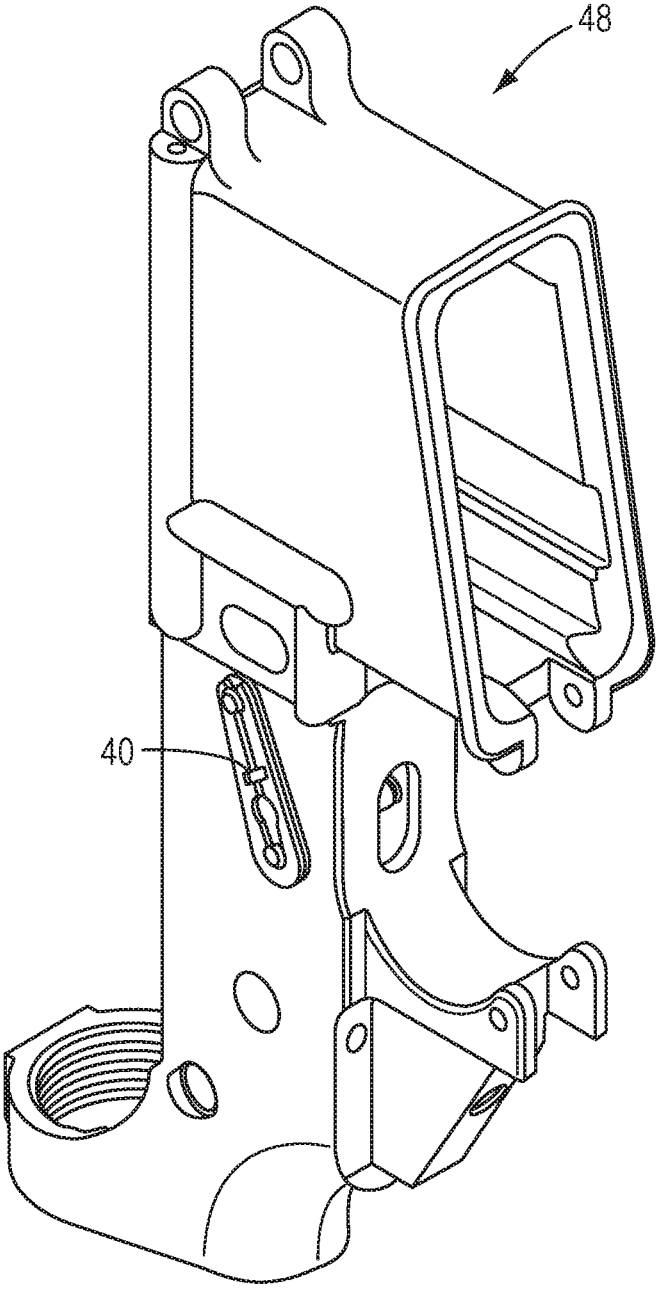
FIG. 3 is a presentation of the pin retention clip mounted in a gun.

The longitudinal through recess 36 extends from the end of the clip 20 proximate the opening 30 to and including a narrowed section 38 of the clip that accommodates the second pin 14 when the clip 20 is in a locked position as shown in FIG. 2 and FIG. 3.

Approximately midway along the length of the longitudinal through recess or slot 36 there is a rectangular cutout 40. This cut-out is used to assist in prying the longitudinal slot open to spread the opening 30 to allow the clip 20 to fit around the first pin 12 when installing or removing the clip 20. In one embodiment a flat bladed, straight-ended key that may ship with the device is used to push on the edge of the rectangular cutout 40 to spread apart the longitudinal recess or slot to remove the clip from interfacing with the pins of the device. In a preferred embodiment a simple screw driver is used to push on the edge of the rectangular cutout to urge the clip 20 to the position shown in FIG. 1 thus allowing the removal of the clip from its locked position on the pins and above the back plate 18.

In another embodiment of the invention the rectangular cutout 40 is replaced with a cutout that is not rectangular. For instance, it was found that a "butterfly wing" shaped cutout could be used. Another cut out shape that worked is two "pie-slice" shapes that have their pointed ends pointed at each other. Similar to the "angel wings" children make in the snow. Any of these shapes function well and the invention should not be limited to only the rectangular cutout shape shown in the figures.

Adjacent and spaced apart from the rectangular cutout 40 is an enlarged opening 42 that has an aperture size slightly larger than the diameter of the second pin 14. The enlarged opening 42 transitions at necked down area 44 to an area 46 that has a curved area and lead-in area 46 that is sized to accommodate the second pin groove 24. The second pin 14 will be held in the curved area 46 by interface between the groove of the second pin 24 and the clip 20 when the clip 20 is urged from the location shown in FIG. 1 to the position of the clip 20 in FIGS. 2 and 3. When in this "locked" position as shown in FIG. 2 the first pin 12, specifically the first pin groove 22, will engage with the first curve and second curves 32 and 34 of the clip 20. The second pin 14, and specifically the second pin grove, will engage with the curved area 46 of the clip 20.

FIG. 3 is a presentation of a gun generally 48. In this case the lower receiver of an AR-15 style weapon is shown. The pin retention clip can be used in many other guns, such as but not limited to AK-47 style rifles, FN FAL style rifles, 10-22 style rifles just to name a few. Pin size and front and back plate lengths, as well as the size of the clip are fixed relative to each other for a particular trigger and gun pair but can be changed for other gun configurations.

In FIG. 3 no trigger module is shown installed but the pin retention device is shown in the deployment it would be in to lock a trigger module into the gun.

Figure 4:
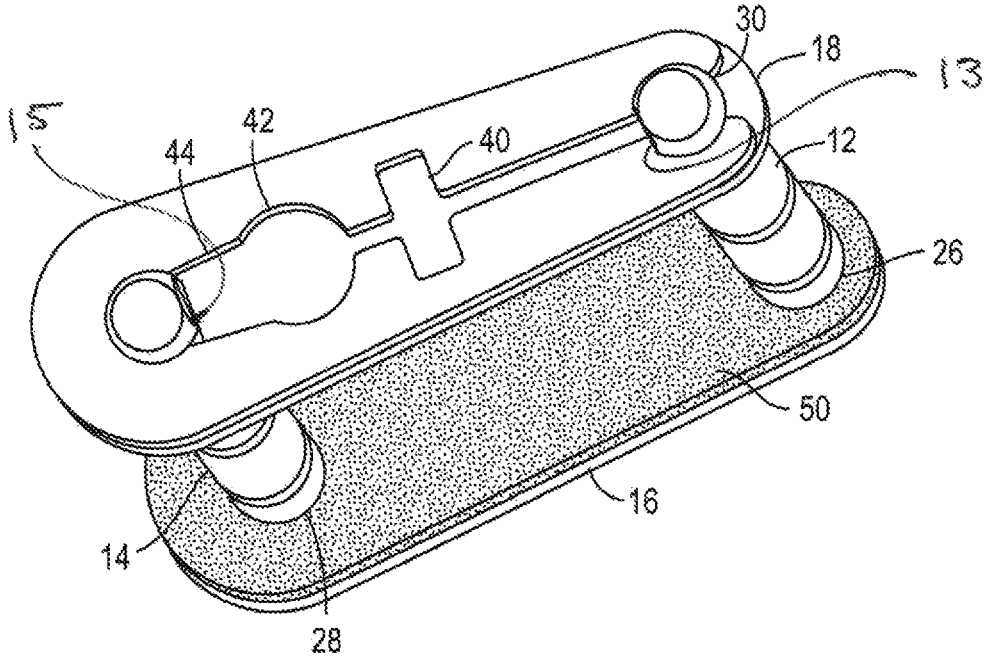
FIG. 4 is an alternative embodiment of the assembly shown in FIGS. 1 and 2.

FIG. 4 is an alternative embodiment of the invention. In this embodiment a layer 50 of foam material is placed adjacent the inside surface of the front plate 16. The foam is used to take up any play between the inboard side of the front plate 16 and the side of the gun and any play between the inboard side of the back plate 18 and the side of the gun. This layer of material is not needed in all installations but is an option. The layer in a preferred embodiment is foam; however any pliable material, such as rubber, leather, soft plastic, paper, or the like could be used as the material of the layer 50.

There are several dimensional options depending on the weapon that the trigger assembly and the pin retention clip are used with. For instance, in an AR-15 style lower receiver the hole spacing for retaining the stock trigger is matched by the pin spacing of the pin retention clip pins. In this case the center-to-center of the two pins matches the gun's hole-to-hole dimension.

In the embodiment for the AK-47 style weapon the lower receiver the hole spacing for retaining the stock trigger is matched by the pin spacing of the pin retention clip pins. In this case the center-to-center of the two pins matches the gun's hole to hole dimension.

In the embodiment for the FN FAL style weapon the lower receiver the hole spacing for retaining the stock trigger is matched by the pin spacing of the pin retention clip pins. In this case the center-to-center of the two pins matches the gun's hole-to-hole dimension.

The front plate 16 and the back plate 18 may also be sized to accommodate the host weapon. In the figures it is clearly shown that the obround shape of the plates (and the layer 50) has a larger radius at one end and a smaller radius at the other end of the obround. The smaller ends of the obround plates are engineered to provide clearance between the plates and a projection on the lower receiver as seen in FIG. 3.

The operation of the pin device for use in retaining a trigger mechanism in a gun is clear from the figures. The starting point of using the device is to remove the trigger mechanism retention pins in a gun. The trigger module/group can be pulled out of the gun and replaced with another trigger module/group. The new trigger module/group is fitted up into the gun and the pin retention clip device is fitted. First the first and second pins are passed into the apertures in the front plate until the flanges of the pins prevent further insertion of the pins into the holes of the front plate. If used, the layer 50 of pliable material is then positioned over the pins to eventually contact the inside surface of the front plate. The front plate, with the pins carried in the front plate, and the layer of material if used, is offered up to side of the lower receiver so that the pins can be inserted into the gun, and through the trigger module/group that was positioned in the gun. The pins are pushed out the "far" side of the gun. The pins now extend and are exposed out the side of the gun. The back plate 18 is positioned over the pins. The narrower end of the back plate is placed toward the same end of the gun as the narrow end of the front plate as is shown in FIGS. 1 and 2. Finally, the clip 20 is placed over the pins and over the back plate with the second pin 14 in the enlarged opening as shown in FIG. 1. The clip 20 is then pushed into locking engagement as shown in FIG. 2. The first 32 and second curve 34 will engage the first pin groove 22 and the curved area 46 of the clip will engage the second pin groove 24. With the clip 20 moved into the locked position shown in FIGS. 2-4 the trigger module/group, if it were shown in FIG. 4 and it is not shown, will be securely carried in the gun 48.

In summary, the invention it is a pin retention clip to allow a trigger assembly in a weapon to be rapidly removed and replaced from the trigger location of the weapon. The pin retention clip is made up several components including a first pin, a second pin, a front plate having apertures sized to allow passage of the first and the second pin through the apertures of the front plate. There is also a back plate having a first aperture and a second aperture, each of the apertures sized to allow passage of the first and the second pins through the first and second apertures of the back plate respectively. One other component is a clip with a first leg and a second leg separated by a longitudinal slot or recess. This clip has a curved area to accommodate the second pin and a first curve and second curve to accommodate the first pin.

The pins of the pin retention clip further comprise the first pin and the second pin each having a flange formed at one end of each pin. These flanges prevent the pins from passing all the way through the apertures in the front plate. Additionally, the first pin may have a flat which is oriented parallel to the longitudinal axis of the first pin, the flat formed on the end of the pin distal from the flange on the first pin. Similarly, the second pin may have a flat which is oriented parallel to the longitudinal axis of the second pin, the flat formed on the end of the pin distal from the flange of the second pin. In one configuration the first and second apertures in the back plate may each have a generally circular hole with a straight section that truncates the circular hole as shown in the figures. The length of these straight sections approximating the length of the transverse flats of each of the pins. The pins when inserted through the back plate will be restrained from rotation due to the transverse flats on the pins interfacing with the straight sections of the circular holes formed in the back plate.

The front plate is an obround shaped flat plate with one end of the front plate having a smaller diameter than the other end of the front plate. The back plate also is an obround shaped flat plate with one end of the back plate having a smaller diameter than the other end of the front plate. In one embodiment of the invention the front plate is an obround shaped flat plate with one end of the front plate having a smaller diameter than the other end of the front plate; and so with the back plate. It is an obround shaped flat plate with one end of the back plate having a smaller diameter than the other end of the back plate.

The longitudinal slot or recess may include an enlarged opening in the clip. The slot has a transition section extending from the enlarged opening, and a curved area integral with the transition section. The enlarged opening, the transition section and the curved area form an extension of the longitudinal slot while the first curve and the second curve form an extension of the longitudinal slot. There may be a rectangular cutout extending transverse to and on either side of the longitudinal slot.

Continuing with the summary of the invention it should be pointed out that the pin retention clip may be sized for various weapons. For instance, in one embodiment the first pin has a diameter of 0.154" and the second pin has a diameter of 0.154." This is for use in an AR-15 style weapon. In another embodiment the first pin has a diameter of 0.197" and the second pin has a diameter of 0.197 for use in an AK-47 style weapon.

In an embodiment of the invention the first pin and the second pin further comprise three circumferential grooves including a first pin groove in the first pin and a second pin groove in the second pin. The three circumferential grooves are formed around the periphery of each of the pins whereby the first pin groove interfaces with the first curve and second curve of the clip to accommodate the first pin. The second groove interfaces with the curved area of the clip to accommodate the second pin when the clip is positioned in a locked position. There may be two grooves on each pin with these grooves located inboard of the front plate and inboard of the back plate when the pin retention clip is in a locked deployment as shown in FIG. 2. The extra grooves not needed to lock the pin retention clip in place are provided to interface with springs if such springs are carried in a particular trigger assembly.

This pin retention clip allows a trigger assembly in a weapon to be rapidly removed and replaced.

In another embodiment of the invention there may also be included a layer of material, referred to as a clip gasket 50, adjacent the front plate (the clip gasket used in this location will have full round holes to accept the pins) or in an alternative embodiment the clip gasket can be adjacent the back plate (in this embodiment the clip gasket will have apertures that have a flat aspect to the holes making up the apertures similar to the apertures in the back plate). This layer of material or clip gasket may have apertures to allow passage of the first and second pins through the layer of material. The clip gasket 50 may be any compressible material and in a preferred embodiment the inventor will use foam.

In addition to the apparatus the method of using the pin retention clip is important. The method of mounting a trigger assembly in a weapon using a pin retention clip, may include the acts of first removing an initial trigger assembly from the gun if the gun has an installed trigger. To use the pin retention clip the technician will position a replacement trigger assembly in the gun from which the initial trigger assembly was removed and feed a first pin into an aperture of a front plate and feeding a second pin into a second aperture of the front plate. If a clip gasket is used it can be positioned over the pins now if it is too be used next to the front plate. Next she will feed the two pins of the assembly comprising the first and second pins and the front plate into near side apertures in the gun, through mounting holes in the replacement trigger, and through off-side apertures in the gun whereby the pins will extend outboard of the gun. If the clip gasket will be used inboard of the back plate it will be positioned now. Next they will position a back plate over the projecting pins and position a clip on top of the back plate. The clip comprises a first leg and a second leg separated by a longitudinal slot. The clip also comprises a curved area to accommodate the second pin and a first curve and second curve to accommodate the first pin. Usually the last act performed by the technician to install the pin retention clip is that they will slide the clip into locking engagement with each pin such that the trigger assembly is retained in the gun by the pin retention clip. In this method it may also be desired to use the layer of material. The compressible material has a first and a second aperture adjacent the front plate. The installation is accomplished by feeding a first pin into an aperture of the layer of material and feeding the second pin into a second aperture of the layer of material.

While the invention is described herein in terms of preferred embodiments and generally associated methods, the inventor contemplates that alterations and permutations of the preferred embodiments and methods will become apparent to those skilled in the art upon a reading of the specification and a study of the drawings.

Accordingly, neither the above description of preferred exemplary embodiments nor the abstract defines or constrains the invention. Rather, the issued claims variously define the invention. Each variation of the invention is limited only by the recited limitations of its respective claim, and equivalents thereof and without limitation by other terms not present in the claim.

The invention claimed is:

1. A pin retention clip to allow a trigger assembly in a weapon to be rapidly removed and replaced from the trigger location of the weapon, the pin retention clip comprising:

a first pin having a flange formed at one end of the first pin, and a flat oriented parallel to the longitudinal axis of the first pin, the flat formed on the end of the first pin distal from the flange on the first pin;

a second pin having a flange formed at one end of the second pin, and a flat oriented parallel to the longitudinal axis of the second pin, the flat formed on the end of the second pin distal from the flange on the second pin;

a front plate having apertures sized to allow passage of the first and the second pins through the apertures of the front plate;

a clip gasket carried adjacent the front plate, the clip gasket having a first and second full round holes to accommodate the first and second pins;

a back plate having a first aperture and a second aperture, the first and second apertures in the back plate each having a generally circular hole with a straight section, the length of the straight section approximating the length of the transverse flats of each of the pins, whereby when the pins are inserted through the back plate the pins are restrained from rotation due to the transverse flats on the pins interfacing with the straight sections of the circular holes formed in the back plate;

a clip having a first leg and a second leg separated by a longitudinal slot, the clip having a curved area to accommodate the second pin and a first curve and second curve to accommodate the first pin.

2. The pin retention clip in accordance with claim 1 wherein the clip gasket is positioned inboard of the front plate.

* * * * *